US007909165B2

(12) United States Patent
Perell

(10) Patent No.: US 7,909,165 B2
(45) Date of Patent: Mar. 22, 2011

(54) SYSTEM FOR DELIVERING SEQUENTIAL COMPONENTS

(75) Inventor: William S. Perell, San Francisco, CA (US)

(73) Assignee: PopPack, LLC, San Francisco, CA (US)

( * ) Notice: Subject to any disclaimer, the term of this patent is extended or adjusted under 35 U.S.C. 154(b) by 717 days.

(21) Appl. No.: 11/724,516

(22) Filed: Mar. 16, 2007

(65) Prior Publication Data

US 2007/0235369 A1 Oct. 11, 2007

Related U.S. Application Data

(60) Provisional application No. 60/790,482, filed on Apr. 10, 2006.

(51) Int. Cl.
*B65D 83/04* (2006.01)

(52) U.S. Cl. ..... 206/532; 206/538; 383/210

(58) Field of Classification Search ..... 206/528, 206/532, 531, 534, 538, 820, 816, 828, 824, 206/389, 390, 484; 383/210, 37, 38, 39
See application file for complete search history.

(56) References Cited

U.S. PATENT DOCUMENTS 3,074,544 A 1/1963 Bollmeier et al.
3,189,227 A 6/1965 Hobbs et al.
3,256,981 A 6/1966 Kurtz
3,294,227 A 12/1966 Schneider et al.
3,301,390 A 1/1967 Via, Jr.
3,405,797 A * 10/1968 Dwyer, Jr. ..... 206/395
3,573,069 A 3/1971 Keller et al.
3,608,709 A 9/1971 Pike
3,635,376 A 1/1972 Hellstrom
3,921,805 A * 11/1975 Compere ..... 206/532
(Continued)

FOREIGN PATENT DOCUMENTS

DE 2 0314741 1/2004
(Continued)

OTHER PUBLICATIONS

PCT Search Report for International Application No. PCT/EP2007/053477, Completed Aug. 14, 2007, Mailed Aug. 22, 2007.

*Primary Examiner* — Ehud Gartenberg
*Assistant Examiner* — King M Chu
(74) *Attorney, Agent, or Firm* — Dority & Manning, P.A.

(57) ABSTRACT

System 10 delivers specified medication(s) 10M of a specified dosage in a specified sequence (see FIG. 1A). Flexible cover lamina 12C is pressed into selective engagement base lamina 12B defining a series of sequential storage units 10X and 10Y and 10Z with frangible seal 14F (no hatching) and destruct seal 14D (double hatching). Sealed medication chamber 16M is proximate the destruct seal within each storage unit. Chamber access region 16R is proximate the frangible seal within each storage unit. Diagonal chamber seal 14S (single hatching) extends across each storage unit. Breachable bubble 16B is positioned within each chamber access region and expands under applied pressure towards the frangible seal of the storage unit (see FIGS. 1A and 1B). The expansion separates the opposed laminae until the bubble produces perimeter breach 12P (see FIG. 1C) in the frangible seal. Flexible peel flap 14C is formed by the flexible cover lamina along the breached frangible seal as the bubble breaches. The flap is peeled away from the base lamina by the user, parting the chamber seal to open the medication chamber providing access to the medication stored therein.

19 Claims, 2 Drawing Sheets

U.S. PATENT DOCUMENTS

| | | | | |
|---|---|---|---|---|
| 4,275,840 | A | 6/1981 | Staar | |
| 4,294,361 | A * | 10/1981 | Margulies et al. | 206/532 |
| 4,301,923 | A | 11/1981 | Vuorento | |
| 4,402,402 | A | 9/1983 | Pike | |
| 4,511,052 | A | 4/1985 | Klein et al. | |
| D279,808 | S | 7/1985 | Pharo | |
| 4,540,089 | A | 9/1985 | Maloney | |
| 4,597,244 | A | 7/1986 | Pharo | |
| 4,610,684 | A | 9/1986 | Knox et al. | |
| 4,632,244 | A | 12/1986 | Landau | |
| 4,704,314 | A | 11/1987 | Hsu et al. | |
| 4,711,359 | A | 12/1987 | White et al. | |
| 4,759,472 | A | 7/1988 | Strenger | |
| 4,793,123 | A | 12/1988 | Pharo | |
| 4,798,288 | A | 1/1989 | Holzner | |
| 4,872,556 | A | 10/1989 | Farmer | |
| 4,872,558 | A | 10/1989 | Pharo | |
| 4,874,093 | A | 10/1989 | Pharo | |
| 4,890,744 | A | 1/1990 | Lane, Jr. et al. | |
| 4,918,904 | A | 4/1990 | Pharo | |
| 4,949,530 | A | 8/1990 | Pharo | |
| 4,961,495 | A | 10/1990 | Yoshida et al. | |
| 5,009,894 | A * | 4/1991 | Hsiao | 424/451 |
| 5,050,736 | A | 9/1991 | Griesbach | |
| 5,100,028 | A | 3/1992 | Siefert | |
| 5,114,004 | A | 5/1992 | Isono et al. | |
| 5,126,070 | A | 6/1992 | Leifheit et al. | |
| 5,207,320 | A | 5/1993 | Allen | |
| 5,215,221 | A | 6/1993 | Dirksing | |
| 5,272,856 | A | 12/1993 | Pharo | |
| 5,325,968 | A | 7/1994 | Sowden | |
| 5,373,966 | A | 12/1994 | O'Reilly et al. | |
| 5,427,830 | A | 6/1995 | Pharo | |
| 5,445,274 | A | 8/1995 | Pharo | |
| 5,447,235 | A | 9/1995 | Pharo | |
| 5,487,470 | A | 1/1996 | Pharo | |
| 5,492,219 | A | 2/1996 | Stupar | |
| 5,588,532 | A | 12/1996 | Pharo | |
| D386,074 | S | 11/1997 | Pharo | |
| 5,711,691 | A | 1/1998 | Damask et al. | |
| 5,775,491 | A | 7/1998 | Taniyama | |
| 5,792,213 | A | 8/1998 | Bowen | |
| 5,814,159 | A | 9/1998 | Paley et al. | |
| 5,865,309 | A | 2/1999 | Futagawa et al. | |
| 5,870,884 | A | 2/1999 | Pike | |
| 5,910,138 | A | 6/1999 | Sperko et al. | |
| 5,928,213 | A | 7/1999 | Barney et al. | |
| 5,944,709 | A | 8/1999 | Barney et al. | |
| 5,957,358 | A * | 9/1999 | Getz et al. | 225/77 |
| 5,967,308 | A | 10/1999 | Bowen | |
| 6,001,187 | A | 12/1999 | Paley et al. | |
| 6,007,264 | A | 12/1999 | Koptis | |
| 6,036,004 | A | 3/2000 | Bowen | |
| 6,068,820 | A | 5/2000 | De Guzman | |
| 6,165,161 | A | 12/2000 | York et al. | |
| 6,198,106 | B1 | 3/2001 | Barney et al. | |
| 6,203,535 | B1 | 3/2001 | Barney et al. | |
| 6,468,377 | B1 | 10/2002 | Sperko et al. | |
| 6,491,159 | B2 * | 12/2002 | Shibata | 206/219 |
| 6,547,468 | B2 | 4/2003 | Gruenbacher et al. | |
| 6,726,364 | B2 | 4/2004 | Perell | |
| 6,773,163 | B2 * | 8/2004 | Ichikawa et al. | 383/204 |
| 6,846,305 | B2 | 1/2005 | Smith et al. | |
| 6,935,492 | B1 | 8/2005 | Loeb | |
| 6,968,952 | B2 | 11/2005 | Crevier et al. | |
| 6,974,032 | B2 * | 12/2005 | Intini | 206/532 |
| 6,996,951 | B2 | 2/2006 | Smith et al. | |
| 7,051,879 | B2 | 5/2006 | Ramet | |
| 7,055,683 | B2 | 6/2006 | Bourque et al. | |
| 7,175,614 | B2 | 2/2007 | Gollier et al. | |
| 7,306,095 | B1 | 12/2007 | Bourque et al. | |
| 2002/0150658 | A1 | 10/2002 | Morrissette et al. | |
| 2002/0170832 | A1 | 11/2002 | Klair | |
| 2003/0019781 | A1 | 1/2003 | Kocher | |
| 2003/0075561 | A1 * | 4/2003 | Pieri | 222/94 |
| 2004/0057638 | A1 * | 3/2004 | Perell et al. | 383/210 |
| 2004/0226848 | A1 * | 11/2004 | Dunn-Rankin | 206/461 |
| 2006/0023976 | A1 | 2/2006 | Alvater et al. | |
| 2006/0126970 | A1 | 6/2006 | Perell | |
| 2007/0241024 | A1 * | 10/2007 | Perell | 206/531 |

FOREIGN PATENT DOCUMENTS

| | | | |
|---|---|---|---|
| EP | 00306207 | A1 | 3/1989 |
| EP | 00317130 | A1 | 5/1989 |
| FR | 2345363 | A1 | 10/1977 |
| GB | 2253605 | A | 9/1992 |
| JP | 04215927 | A | 8/1992 |
| JP | 11029176 | A | 2/1999 |
| JP | 2000255598 | A | 9/2000 |
| WO | WO 96/23700 | A1 | 8/1996 |
| WO | WO 02/083504 | A1 | 10/2002 |
| WO | WO 2004/100856 | A2 | 11/2004 |
| WO | 2005022323 | A | 3/2005 |
| WO | WO 2005/077811 | A1 | 8/2005 |

* cited by examiner

SYSTEM FOR DELIVERING SEQUENTIAL COMPONENTS

This application claims the benefit of provisional application Ser. No. 60/790,482, filed Apr. 10, 2006.

TECHNICAL FIELD

This invention relates to delivering sequential components, and more particularly delivering the components in an easy to open storage unit.

BACKGROUND

Traditionally, patients and other pill-takers along with their caretakers execute a weekly pill-fill ritual. They gather their stock jars and bottles other repositories of their medication stock, and load a seven-day receptacle. Each bin of the receptacle holds all the medications for the day, or for a particular time period. The pill-fill requires the pill takers or caretaker to know where the pill supplies are stored, and which medications are to be taken, and at what time. For many pill-takers, the print on the medication bottle is too small for them to read. The caps and closure devices can be difficult to remove. Transferring the small pills to the proper small bin container can be a trial.

SUMMARY

It is therefore an object of this invention to provide a series of sequential storage units for presenting small components such as parts or medication in an easy to open storage unit. A breachable bubble on the storage unit is compressed causing a edge breach with peel flaps that can be pulled back to open the storage unit. Self-assembly products may require a dozen assembly steps involving hundreds of small parts of many sizes such as bolts, nuts, washers, screws, brackets, and small tools. Each step entails a specified group of parts. The assembler must locate and use each part in a specified sequence for orderly assembly of the product.

It is another object of this invention to provide such a series of sequential storage units which are loaded with medication by qualified people under controlled conditions. The storage units may be automatically loaded at major hospitals and mail-order pharmaceutical warehouses. Orders are filled by trained clerks and skilled technicians using reliable computers and extensive data bases.

It is a further object of this invention to provide such a series of sequential storage units for sequentially presenting medications for sequential delivery. As each storage unit is presented and the medications disbursed, it is intuitively clear which of the remaining storage unit is next.

Briefly, these and other objects of the present invention are accomplished by providing a system for delivering specified components of a specified quantity in a specified sequence. A base lamina and a flexible cover lamina are pressed into opposed selective engagement defining a series of sequential storage units. A perimeter seal formed around each storage unit has a frangible seal portion and a destruct seal portion. A sealed medication chamber within each storage unit proximate the destruct seal stores a dosage of the medication. A chamber access region within each storage unit is proximate the frangible seal portion for accessing the medication chamber. A chamber seal formed by the selective engagement of the opposed laminae, extends across each storage unit between the medication chamber and the chamber access region. A breachable bubble is formed within each chamber access region by the opposed laminae during the selective engagement. The bubble is between the frangible seal portion and the chamber seal. The bubble expands under applied pressure towards the frangible seal portion of the storage unit. The expansion separates the opposed laminae forming the bubble, until the bubble produces a perimeter breach in the frangible seal portion. A flexible peel flap is formed by the flexible cover lamina along the breached frangible seal portion as the bubble breaches. The flap may be peeled away from the base lamina detaching the chamber seal to open the medication chamber providing delivery of the medication stored therein.

BRIEF DESCRIPTION OF THE DRAWINGS

Further objects and advantages of the sequence of storage units and the operation of the breachable bubble will become apparent from the following detailed description and drawings (not drawn to scale) in which.

Figure 1A:
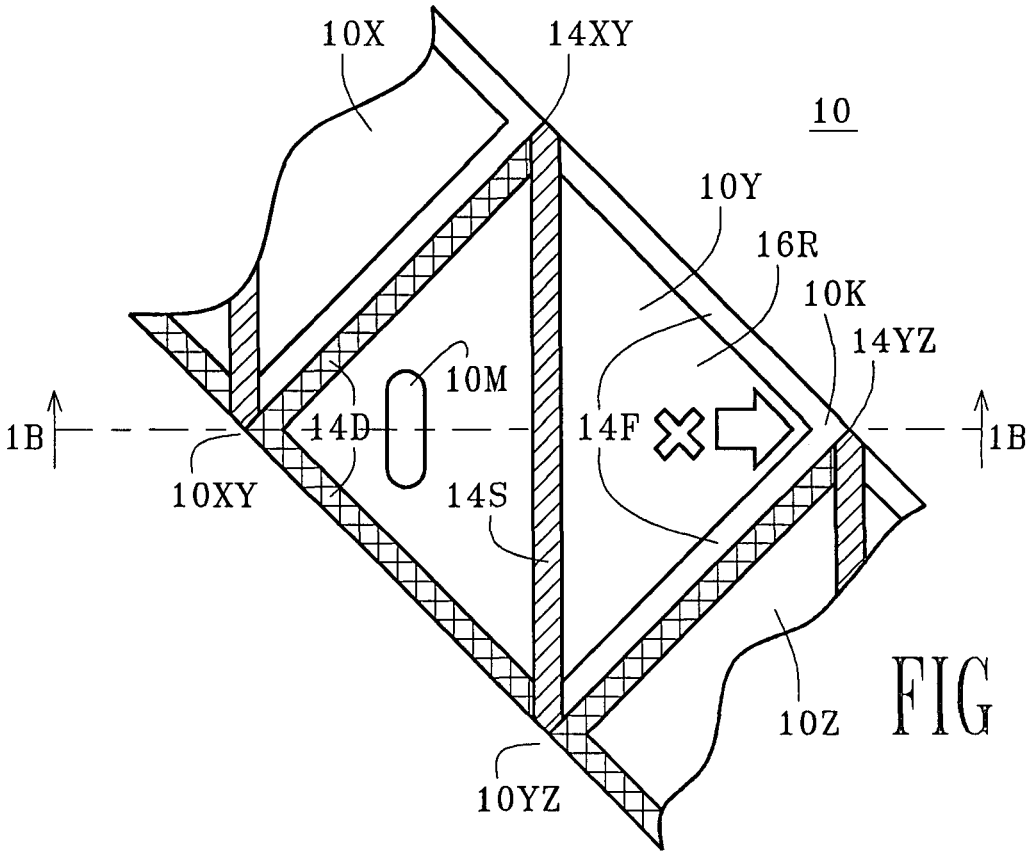
FIG. 1A is a fragmentary top view of a series of storage units 10X and 10Y and 10Z showing medication chamber 16M containing medications 10M.

The first digit of each reference numeral in the above figures indicates the figure in which an element or feature is most prominently shown. The second digit indicates related elements or features, and a final letter (when used) indicates a sub-portion of an element or feature.

REFERENCE NUMERALS IN DRAWINGS

The table below lists the reference numerals employed in the figures, and identifies the element designated by each numeral.

| 10 Delivery system | |
|---|---|
| 10K | Corner |
| 10M | Medication(s) |
| 10X | Sequential Storage Unit |
| 10Y | Sequential Storage Unit |
| 10Z | Sequential Storage Unit |
| 10XY | Boundary |
| 10YZ | Boundary |
| 12B | Base Lamina |
| 12C | Cover Lamina |
| 12P | Perimeter Breach |
| 14B | Base Flexible peel flap |
| 14C | Cover Flexible peel flap |
| 14D | Destruct Seal Portion (left and right) |
| 14F | Frangible Seal Portion (left and right) |
| 14S | Diagonal Chamber Seal |
| 14XY | Tear-Away Cut Lines |
| 14YZ | Tear-Away Cut Lines |
| 16B | Breachable Bubble |

-continued

| | |
|---|---|
| 16M | Sealed Medication Chamber |
| 16R | Chamber Access Region |
| | 20 Delivery Sheet |
| 20K | Corner |
| 20U | Sequential Storage Unit |
| 24P | Tear-Away Perforations 24P |
| 26R | Chamber Access Region |
| | 30 Delivery Strip |
| 30L | Medical Data Label |
| 30U | Sequential Storage Unit |
| 32B | Base Lamina |
| 32C | Cover Lamina |
| 32T | Catch Tray |
| 34F | Frangible Seal Portions |
| 36M | Medication Chamber |
| 36R | Chamber Access Region |
| 40M | Medications |
| 40U | Sequential Storage Unit |
| | 48 Delivery Spool |
| 48D | Medication Dispenser |
| 48M | Inner Mooring End |
| 48T | Outer Terminal End |
| | 50 Calendar Matrix |
| 50A | am Storage Unit |
| 50P | pm Storage Unit |
| 50U | Storage Units |
| 52B | Rigid Base Lamina |

General Embodiment—(FIG. 1ABC)

Figure 1B:
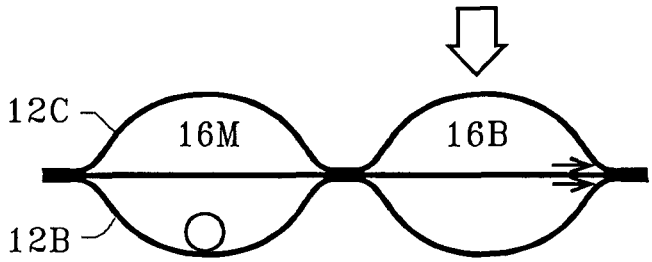
FIG. 1B is a fragmentary sectional view taken generally along reference line IB-IB of FIG. 1A prior to the breaching of bubble 16B.

System 10 delivers specified components in specified quantities such as medication(s) 10M of a specified dosage, in a specified sequence (see FIG. 1A). Flexible cover lamina 12C is pressed into selective engagement base lamina 12B (see FIG. 1B). The selective engagement of the opposed laminae defines a series of sequential storage units 10X and 10Y and 10Z. A perimeter seal is formed around each storage unit by the pressed selective engagement. The perimeter seal has a frangible seal portion and a destruct seal portion. The perimeter seal for storage unit 10Y has frangible seal portion 14F (no hatching) and destruct seal portion 14D (double hatching). A frangible seal formed by two laminae heat pressed together can be separated without harmful damage to either lamina, simply by pulling the laminae apart. A destruct seal, however, cannot be separated without damage to one or both of the laminae.

Figure 1C:
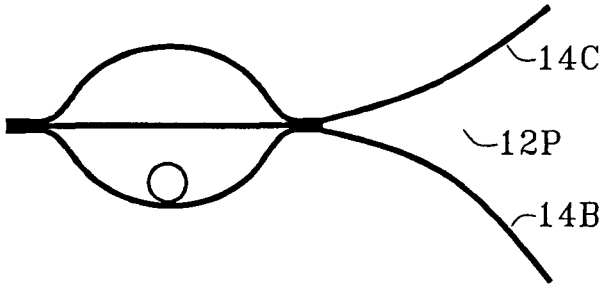
FIG. 1C is a fragmentary side view of the storage units after to the breaching of bubble 16B.

Sealed medication chamber 16M for storing a dosage of the medication, is proximate the destruct seal within each storage unit. Chamber access region 16R for accessing the medication chamber, is proximate the frangible seal portion within each storage unit. Diagonal chamber seal 14S (single hatching) formed by the pressed selective engagement of the opposed laminae, extends across each storage unit between the medication chamber and the chamber access region. Breachable bubble 16B is positioned within each chamber access region between the frangible seal portion and the chamber seal. The bubble is formed by a volume gas, such as ambient air, trapped between the opposed laminae during the selective engagement. The bubble expands under applied pressure towards the frangible seal of the storage unit (see FIGS. 1A and 1B). The expansion separates the opposed laminae forming the bubble, until the bubble produces perimeter breach 12P (see FIG. 1C) in the frangible seal portion. Flexible peel flap 14C is formed by the flexible cover lamina along the breached frangible seal as the bubble breaches. The flap is peeled away from the base lamina by the user, parting the chamber seal to open the medication chamber providing access to the medication stored therein. The user may be the patient who is under medication, or the caretaker who administers the medication or other healthcare professional.

The bubble is expandable to open the package by external pressure applied by a consumer. For small bubbles, the consumer may simply pinch a bubble or bubbles between his thumb and forefinger. Slightly larger bubbles may require thumb-to-thumb pressure. The very young and older, infirm consumers may push downward on the bubble against a flat surface with a smooth aide such as a spoon. The consumer may direct the bubble expansion outward towards edge of the package by applying the pressure along the inward side of the bubble proximate point "X". Inward expansion of the bubble is limited because the applied pressure keeps the opposed laminae pressed together in sealing engagement along the inward side. Therefore, expansion due to the directed pressure is primarily outward urging the bubble outward towards the edge of the package, as indicated by the large outward arrow. The outward bubble expansion progressively separates the opposed laminae forming the outer seal, along a moving separation frontier. The frontier moves across the outer seal until the frontier reaches the edge of the package, where the bubble breaches creating edge breach.

The destruct seals are stronger than the frangible seals due to a higher temperature and/or pressure and/or dwell-time during the pressing stage of seal formation. That is, the destruct seals are fused together more than the frangible seals. Preferably the chamber seal has a strength greater than the weak frangible seal but not as great as the strong destruct seal. The chamber seal is stronger than the weak frangible seal so that the chamber seal will not separate during breaching of the bubble which produces the perimeter breach. The chamber seal is weaker than the strong destruct seal so that the medication chamber can be pulled opened after breach of the frangible seal.

U.S. Pat. No. 6,726,364 issued on Apr. 27, 2004 to the present inventor shows a breaching bubble which provides opposed peel flaps along a perimeter breach. The flaps are peeled back by the user to open a chamber and present a product. The subject matter of U.S. Pat. No. 6,726,364 is hereby incorporated by reference in its entirety into this disclosure.

Diagonal Chamber Seal—FIG. 1A

Figure 2:
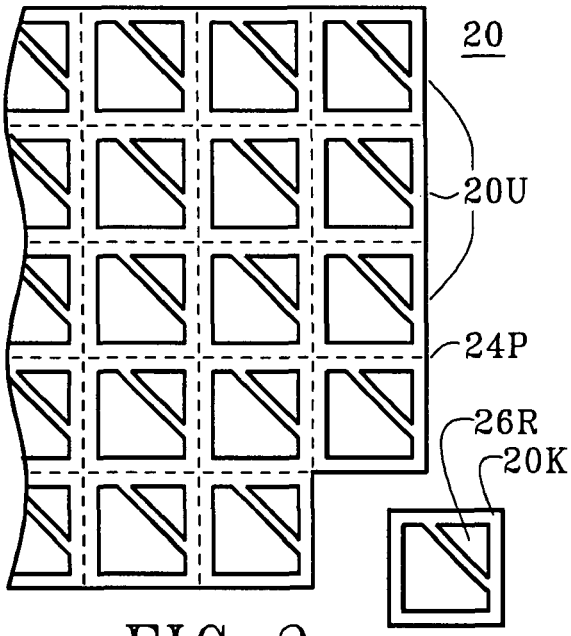
FIG. 2 is a fragmentary top view of delivery sheet 20 of storage units 20U.
Figure 3:
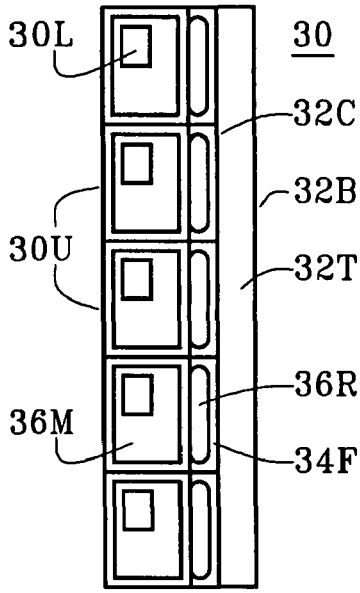
FIG. 3 is a top view of delivery strip 30 of storage units 30U showing catch tray 32T.

The chamber seal within each storage unit may extend diagonally across the storage unit between the medication chamber and the chamber access region. Diagonal chamber seal 14S (see FIG. 1A) defines triangular shapes for medication chamber 16M and chamber access region 16R. The triangular medication chamber has destruct seals 14D (left and right) along the two legs, and diagonal chamber seal 14S across the hypotenuse. The triangular chamber access region has frangible seals 14F (left and right) along the two legs, and chamber seal 14S across the hypotenuse. The chamber seal is about 1.4 times as long as a single leg of the frangible seal. When the chamber seal is parted, the user has maximum finger or hand access to the medications in the medication chamber. Other non-diagonal configurations may be employed. FIG. 2 shows a non-symmetrical embodiment in which chamber access region 26R is limited to a small area in corner 20K. FIG. 3 shows a straight embodiment in which medication chamber 36M is larger than chamber access region 36R.

The boundaries between the sequential storage units has both a destruct seal and a frangible seal. Boundary 10XY between unit 10X and 10Y has frangible seal 14F (right) of unit 10X, adjacent to destruct seal 14D (left) of unit 10Y. Likewise, boundary 10YZ between unit 10Y and 10Z has frangible seal 14F (right) of unit by, adjacent to destruct seal 14D (left) of unit 10Z. The frangible seal must peel away as a storage unit is opened, leaving the adjacent destruct seal intact for maintaining the integrity of the adjacent storage unit. Cover lamina 12C has tear-away cut line 14XY along boundary 10XY, and tear-away cut line 14YZ along boundary 10YZ. The cut lines are between the frangible seal and the destruct seal to permit the cover lamina of one storage unit to pull-away from the cover lamina of the adjacent storage unit. This tear-away cut line is preferable a depth controlled laser cut through the cover lamina, which terminates at the base lamina.

The delivery system may have a flexible cover lamina with a rigid base lamina, which provides a single flexible peel flap. The user holds the rigid base down and pulls the flexible flap away to expose the medication. Alternatively, base lamina 12B may also be flexible forming flexible peel flap 14B opposed to peel flap 14C formed by flexible cover lamina 12C (see FIG. 1C). The pair of peel flaps facilitates pulling apart the chamber seal.

The peel flaps may be positioned at a corner of each storage unit. Corner 10K permits ease of gripping the peel flaps by the user (see FIG. 1C) and peeling them back unsealing frangible seal 14F (left and right). Alternatively, the peel flap may be positioned in the middle between two corners (see FIG. 3).

Strip Embodiment—FIG. 3

The base lamina and cover lamina may be a strip for sequential presentation of the series of sequential storage units in a strip array. Base lamina strip 32B (see FIG. 3) may be wider than cover lamina strip 32C and extend beyond perimeter frangible seal portion 34F of the cover lamina. This extension provides tray 32T for catching the stored medications as they are delivered. The catch tray may have a raised edge berm for retaining the medication on the tray.

Figure 4:
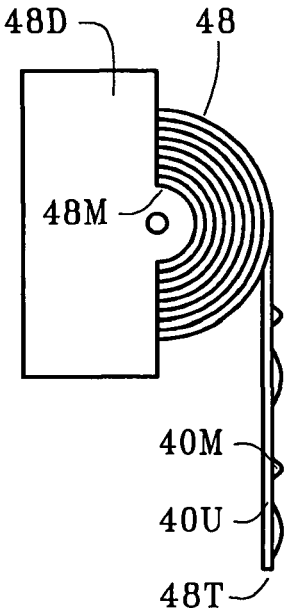
FIG. 4 is a side view of medication dispenser 48D for supporting delivery spool 48 containing a roll of sequential storage units 40U.

The strip of opposed laminae may be wound onto delivery spool 48 (see FIG. 4) with inner mooring end 48M and outer terminal end 48T, for sequential presentation of the strip of sequential storage units from the terminal end. Medication dispenser 48D may be provided for supporting the delivery spool and the storage units. Medications 40M may be vacuum packed within the sealed medication chambers on the strip of storage units. Removing the air from the medication chamber reduces the shipping volume and spool size requirements. Even a slight vacuum locks the medications in place during shipment and handling, preventing them from grinding against one another. Alternatively, an inert gas may be provided within the sealed medication chamber for preserving the medication. A nitrogen flush introduced just before sealing the medication chamber displaces the ambient oxygen.

The cover lamina may be transparent permitting visible identification of the medication. Medications are frequently known to the user or caretaker only by color or size or shape. The lamina may be color coded to indicate the period of day for taking the medications. For example, pink may indicate morning, yellow may indicate noon, and blue may indicate evening. Alternatively, the cover lamina and the base lamina may be opaque for preventing UV and other photo damage.

Figure 5:
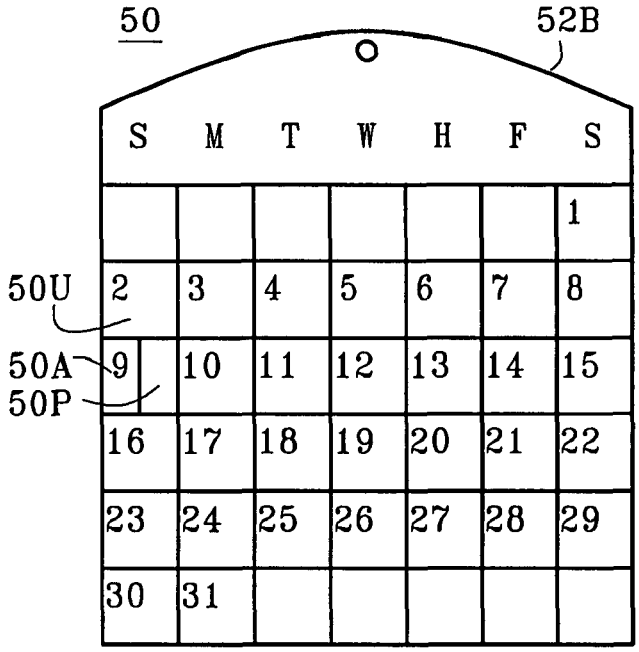
FIG. 5 is a front view of a calendar medication delivery system 50 having rigid base 52B.

Row and Column Embodiments—FIG. 2 and FIG. 5

The series of sequential storage units may be a matrix of rows and columns across a sheet of opposed laminae. The entire inventory of medication can be seen at a glance. A series of tear-away perforations 24P (see FIG. 2) traverse the matrix between adjacent storage units 20U, permitting presentation of a single storage unit. A medication storage unit may be torn-away from the matrix and distributed individually. Alternatively, each of the sequential storage units may be firmly secured to the preceding storage unit and to the succeeding storage unit (see FIG. 3) along the strip of opposed laminae. The empty storage units remain on the strip after delivery, along with the full storage units containing forgotten medication, as a record of compliance.

Calendar matrix 50 of sequential storage units 50U may have a plurality of horizontal rows corresponding to the weeks of a particular month. The matrix may also have seven vertical columns corresponding to the seven days of each week. The user can easily locate and identify the medication for each day. The calendar day may be divided into am and pm storage units 50A and SOP as shown for Tuesday the 4th in FIG. 5. The base lamina for the calendar matrix may be sufficiently rigid to be self standing and function as a stand-up display of the matrix of storage units and of the medications sequentially stored therein.

Medical Data

Medical data relating to the medication may be associated with each storage unit. The name and dosage of the medication may be listed along with the schedule (date and time of day for taking). Important side effects and emergency numbers may be listed. The patient's name and age, and the name of the doctor or caretaker may be provided. The medical data may be printed directly on the lamina, or on label 30L later affixed to the lamina (see FIG. 3), or inserted into the medication chamber or chamber access region. The basic information may be included in a quick scan format such as bar code. More extensive data, such as medical history may be included in a suitable mega format such as toned digital data.

INDUSTRIAL APPLICABILITY

It will be apparent to those skilled in the art that the objects of this invention have been achieved as described hereinbefore. Various changes may be made in the structure and embodiments shown herein without departing from the concept of the invention. Further, features of embodiments shown in various figures may be employed in combination with embodiments shown in other figures. Therefore, the scope of the invention is to be determined by the terminology of the following claims and the legal equivalents thereof.

I claim:

1. System for delivering specified components in specified quantities in a specified sequence, comprising:

a base lamina;

a flexible cover lamina opposed to the base lamina;

a perimeter seal sealing the cover lamina to the base lamina, forming a series of sequential storage units, the perimeter seal having a frangible seal portion and a destruct seal portion, the destruct seal portion formed such that the base lamina and the cover lamina cannot be separated at the destruct seal portion without damage to at least one of the base lamina and the cover lamina;

a chamber seal extending across each of the series of sequential storage units and further sealing the cover lamina to the base lamina;

a component chamber within each of the series of sequential storage units defined by the chamber seal and the destruct seal portion;

a chamber access region within each of the series of sequential storage units defined by the chamber seal and the frangible seal portion;

a breachable bubble within each chamber access region and formed by the cover lamina and the base lamina;

wherein expansion of the breachable bubble due to directed pressure causes progressive separation of the cover lamina and the base lamina at the frangible seal portion until the breachable bubble produces a perimeter breach in the frangible seal portion; and a flexible peel flap formed by the flexible cover lamina along the breached frangible seal portion as the breachable bubble breaches, which flap is peeled away from the base lamina at the chamber seal, breaching the chamber seal to open the component chamber and provide delivery of the components stored therein.

2. The system of claim 1, wherein the flexible peel flap is positioned at a corner of each of the series of sequential storage units.

3. The system of claim 1, wherein the chamber seal within each of the series of sequential storage units extends diagonally across the storage unit between the component chamber and the chamber access region.

4. The system of claim 1, wherein the base lamina is also flexible forming a peel flap opposed to the peel flap formed by the flexible cover lamina.

5. The system of claim 1, wherein the base lamina and the cover lamina are strips forming a strip for sequential presentation of the series of sequential storage units.

6. The system of claim 5, further comprising a series of tear-away perforations traversing the strips of base lamina and cover lamina between each of the sequential storage units, to permit presentation of a single storage unit.

7. The system of claim 5, wherein the base lamina strip is wider than the cover lamina strip and extends beyond the perimeter frangible seals of the cover lamina to provide a tray for catching the stored components as they are delivered.

8. The system of claim 5, wherein the strips of base lamina and cover lamina wound onto a delivery spool, and have an inner mooring end and an outer terminal end for sequential presentation of the strip of sequential storage units from the terminal end.

9. The system of claim 8, further comprising a dispenser for supporting the delivery spool during the sequential presentation of the strip of sequential storage units.

10. The system of claim 1, wherein each of the series of sequential storage units is firmly secured to the preceding storage unit and to the succeeding storage unit along the strips of base lamina and cover lamina.

11. The system of claim 1, wherein the cover lamina is transparent permitting visible identification of the components.

12. The system of claim 1, wherein the cover lamina and the base lamina are opaque.

13. The system of claim 1, further comprising component data associated with each storage unit and related to the components stored therein.

14. The system of claim 1, wherein the specified components are specified medications of specified dosages delivered in a specified sequence.

15. The system of claim 14, wherein the series of sequential storage units is a matrix of rows and columns across the opposed laminae.

16. The system of claim 15, wherein the base lamina is sufficiently rigid to be self standing and function as a stand-up display of the matrix of storage units and of the medications sequentially stored therein.

17. The system of claim 15, wherein the matrix of rows and columns of the sequential storage units has a plurality of horizontal rows corresponding to the weeks of a particular month, and has seven vertical columns corresponding to the seven days of each week.

18. The system of claim 14, wherein the medications are vacuum packed within the component chamber.

19. The system of claim 14, further comprising an inert gas within the component chamber for preserving the medication.

* * * * *